US006821140B2

(12) United States Patent
Wu

(10) Patent No.: US 6,821,140 B2
(45) Date of Patent: Nov. 23, 2004

(54) ELECTRICAL CABLE CONNECTOR ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/305,716

(22) Filed: Nov. 27, 2002

(65) Prior Publication Data

US 2004/0102076 A1 May 27, 2004

(51) Int. Cl.[7] ..... H01R 13/627
(52) U.S. Cl. ..... 439/362
(58) Field of Search ..... 439/362, 364, 439/365, 76.1

(56) References Cited

U.S. PATENT DOCUMENTS 2,526,325 A * 10/1950 Burtt et al. ..... 439/364
3,718,887 A * 2/1973 Solomon et al. ..... 439/362
5,342,216 A * 8/1994 Davis et al. ..... 439/362
5,782,645 A * 7/1998 Stobie et al. ..... 439/289
5,920,459 A * 7/1999 Weber et al. ..... 361/752

* cited by examiner

*Primary Examiner*—Phuong Dinh
(74) *Attorney, Agent, or Firm*—Wei Te Chung

(57) ABSTRACT

An electrical cable connector assembly (1) includes a contact module (20), an upper cover (40), a lower cover (50), a pair of fastening members (60), an electrical cable (70) and a pair of screws (80). The contact module has an insulative housing (22) assembled with the lower cover, a number of electrical contacts (24) mounted to the insulative housing and a printed circuit board (26) assembled to the insulative housing. The electrical cable is electrically connected with the electrical contacts through the printed circuit board. The upper cover is assembled to the lower cover with the help of the screws and together with the upper cover movably secures the fastening members therebetween. Each of the fastening member includes a transitional portion for engaging with an engaging section of a passage defined by the upper and the lower covers.

6 Claims, 9 Drawing Sheets

ELECTRICAL CABLE CONNECTOR ASSEMBLY

BACKGROUND OF THE INVENTION

1. Field of the Invention

The present invention relates to an electrical connector, and particularly to an electrical cable connector assembly.

2. Description of the Related Art

It is well known that electrical cable connector assemblies terminate with electrical cables and electrically connect with complementary electrical connectors to transmit signals from the electrical cables to the complementary electrical connectors. Most of the electrical cable connector assemblies and the complementary electrical connectors corresponding thereto are formed with interlocking mechanisms to prevent two mated electrical connectors from disengaging from each other.

U.S. Pat. Nos. 5,788,534, 5,820,412, 4,961,711, 5,009,616, 5,011,424, and 5,124,506 respectively disclose cable end connector assemblies comprising locking mechanisms for latching with electrical connectors complementary thereto.

However, with the development of the electronic industry, more stringent requirements have been applied to the electrical connectors; all of the locking mechanisms of the above mentioned patents are not good enough for some new electrical connectors utilized in some more stringent environments, for example, in the environments where the problems of vibrations are very severe.

The inventor of this application has suggested some solutions to meet the need of the industry, such as those disclosed in U.S. patent application Ser. Nos. 10/210,129 filed on Jul. 31, 2002 and entitled "ELECTRICAL CONNECTOR HAVING A LATCH MECHANTSM", now U.S. Pat. No. 6,722,912, Ser No. 10/227,044 filed on Aug. 23, 2002 and entitled "ELECTRICAL CONNECTOR HAVING A LATCH MECHANISM", now U.S. Pat. No. 6,648,666, Ser. No. 10/217,636 filed on Aug. 12, 2002 and entitled "ELECTRICAL CONNECTOR HAVING A LATCH MECHANISM", now U.S. Pat. No. 6,641,425, Ser. No. 10/226,729 filed on Aug. 23, 2002 and entitled "ELECTRICAL CONNECTOR HAVING AN AUTOMATICALLY REMOVABLE PULL TAB AND LATCHES", now U.S. Pat. No. 6,648,665, Ser. No 10/244,890 filed on Sep. 16, 2002 and entitled "ELECTRICAL CONNECTOR HAVING A LOCKER FOR ENABLING THE CONNECTOR TO HAVE A RELIABLE CONNECTION WITH A MATED CONNECTOR", now U.S. Pat. No. 6,592,391, Ser. No. 10/245,188 filed on Sep. 16, 2002 and entitled "ELECTRICAL CONNECTOR HAVING IMPROVED PULL TAB", now U.S. Pat. No. 6,659,790, Ser. No. 10/235,290 filed on Sep. 4, 2002 and entitled "ELECTRICAL CONNECTOR HAVING IMPROVED LATCH MECHANISM", now U.S. Pat. No. 6,702,602, Ser. No 10/236,597 filed on Sep. 5, 2002 and entitled "ELECTRICAL CONNECTOR HAVING ENGAGING DEVICE", now U.S. Pat. No. 6,702,603, Ser. No. 29/167,249 filed on Sep. 10, 2002 and entitled "ELECTRICAL CONNECTOR", Ser. No. 29/167,248 filed on Sep. 10, 2002 and entitled "ELECTRICAL CONNECTOR", now U.S. Pat. No. D478,548, and Ser. No. 29/167,262 filed on Sep. 10, 2002 and entitled "ELECTRICAL CONNECTOR".

However, for some customers, they want a locking mechanism which can provide a more reliable retention between the two mating electrical connectors and which is used in a manner that they are familiar with.

Therefore, an electrical cable connector assembly with an improved locking mechanism is desired.

SUMMARY OF THE INVENTION

A major object of the present invention is to provide an electrical cable connector assembly which comprises a locking mechanism operated in a manner that a user is more familiar with and can ensure a reliable locking between the electrical cable connector assembly and a complementary electrical connector.

An electrical cable connector assembly in accordance with the present invention comprises a contact module, an upper die cast cover, a lower die cast cover, a pair of fastening members, an electrical cable and a pair of screws. The contact module comprises an insulative housing, a plurality of electrical contacts mounted to the insulative housing and a printed circuit board assembled to the insulative housing and electrically connecting with the electrical contacts. The lower cover receives the contact module therein. The electrical cable extends into the lower cover and electrically connects with the electrical contacts through the printed circuit board. The upper cover is assembled to the lower cover and together with the lower cover defines a pair of passages at two lateral sides thereof to movably secure the fastening members therethrough. Each of the fastening members comprises a transitional portion to engage with engaging sections of the passages, thereby increasing the retention between the fastening members and the covers and ensuring the mating between the electrical cable connector assembly and the complementary electrical connector.

Other objects, advantages and novel features of the invention will become more apparent from the following detailed description of the present embodiment when taken in conjunction with the accompanying drawings.

DETAILED DESCRIPTION OF THE INVENTION

Figure 1:
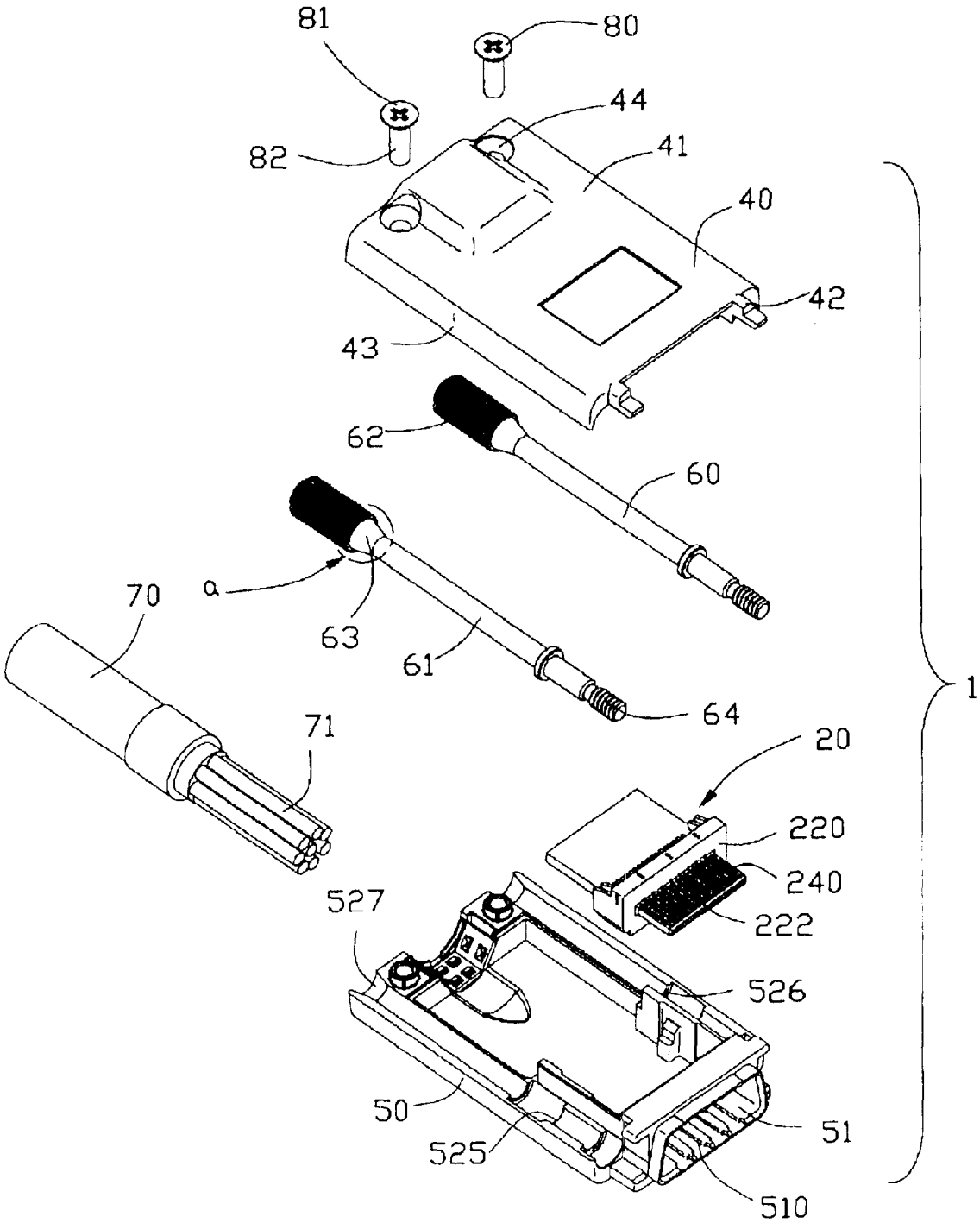
FIG. 1 is an exploded perspective view of an electrical cable connector assembly in accordance with the present invention.
Figure 2:
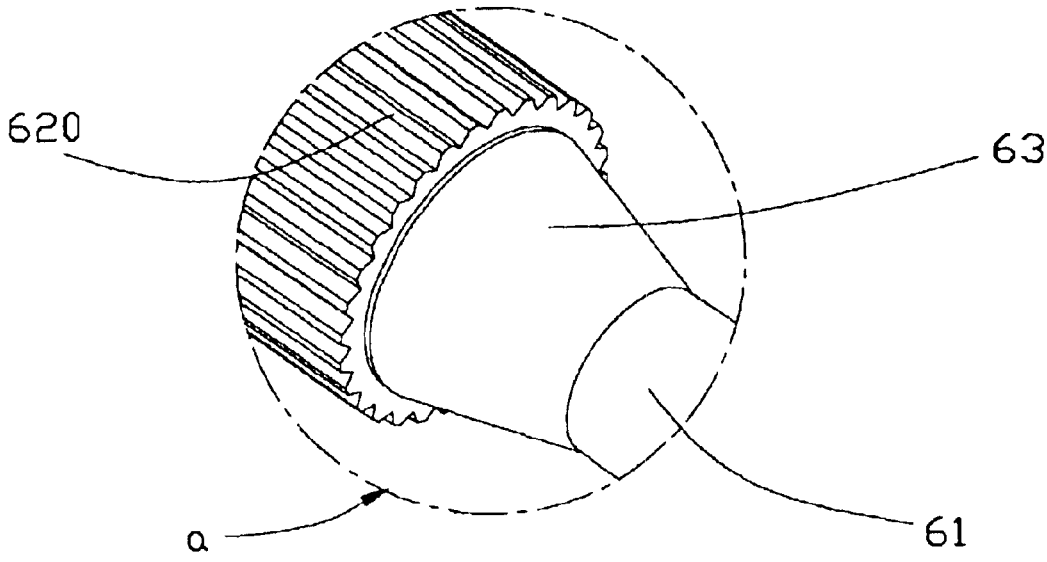
FIG. 2 is a partially enlarged perspective view taken from a circle a of FIG. 1.
Figure 3:
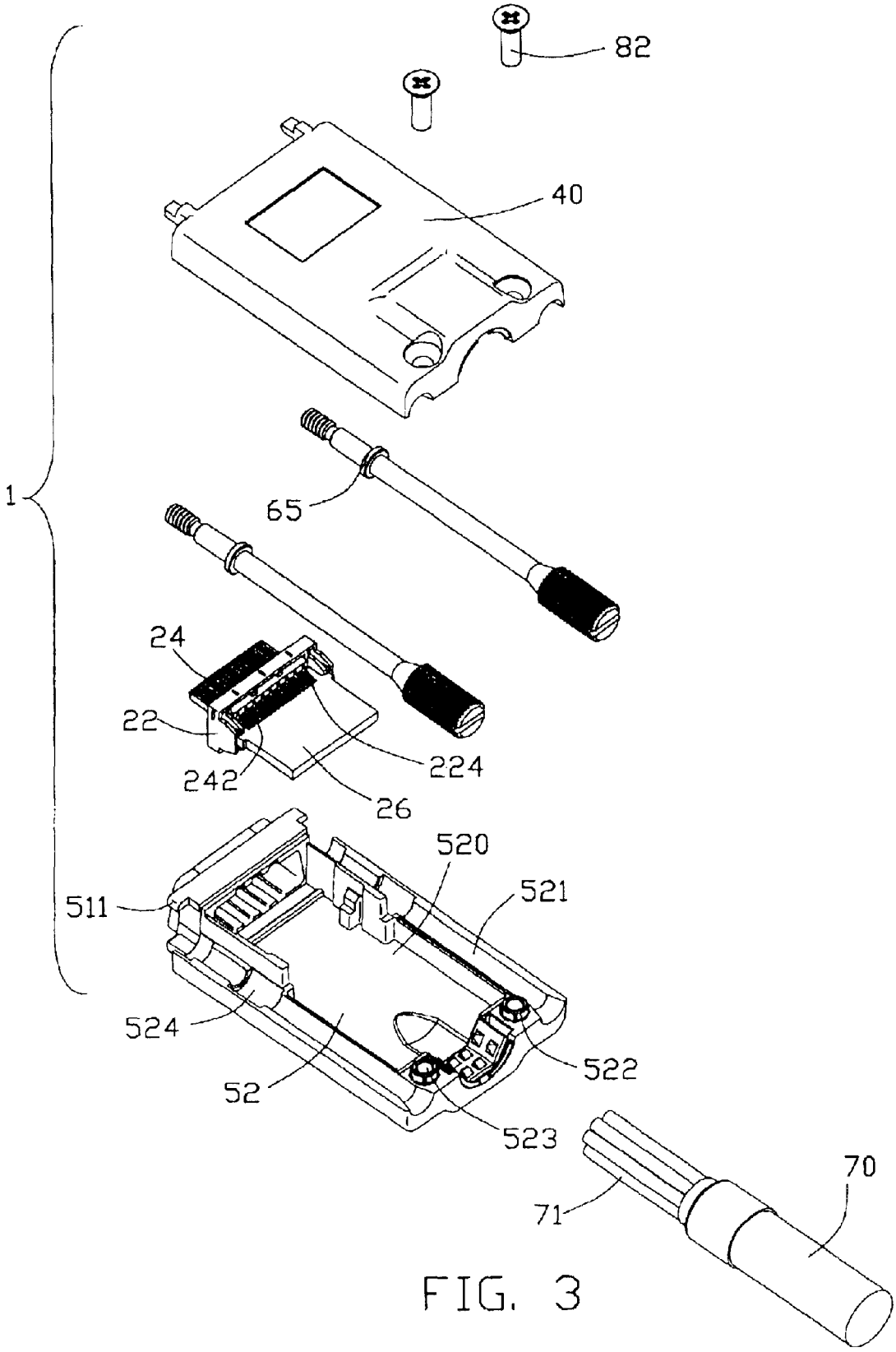
FIG. 3 is a view similar to FIG. 1, but taken from another perspective.

Referring to FIGS. 1, 2 and 3, an electrical cable connector assembly 1 in accordance with the present invention comprises a contact module 20, an upper die cast cover 40, a lower die cast cover 50, a pair of fastening members 60, an electrical cable 70 and a pair of screws 80.

The contact module 20 comprises an insulative housing 22, a plurality of electrical contacts 24 and a printed circuit board 26. The insulative housing 22 comprises a base portion 220, a tongue portion 222 extending forwardly from a front face of the base portion 220 and a plurality of passageways 224 extending from the tongue portion 222 through the base portion 220.

The electrical contacts 24 are received in the passageways 224 of the insulative housing 22 and are retained by the base portion 220 of the insulative housing 22. Each electrical contact 24 comprises a contact portion 240 protruding partially beyond a corresponding one of upper and lower surfaces of the tongue portion 222 for contacting with a corresponding electrical contact of an electrical connector (not shown) complementary to the electrical cable connector assembly 1 and a connect portion 242 extending in a direction opposite to the contact portion 240 beyond a rear face of the base portion 220.

The printed circuit board 26 is assembled to the base portion 220 of the insultive housing 22 and is straddled by and electrically connected with the connect portions 242 of the electrical contacts 24 at one end thereof.

The upper cover 40 comprises a generally planar body portion 41, a pair of spaced fingers 42 extending forwardly from a front end of the body portion 41, and a pair of flanges 43 extending curvedly downwardly from two lateral sides of the body portion 41. The body portion 41 defines a pair of through holes 44 adjacent to a rear end thereof.

The lower cover 50 comprises a hollow frame 51 defining a cavity 510 therein and a cover body 52 extending rearwardly of the frame 51 and defining a space 520 in communication with the cavity 510. The frame 51 is formed with a pair of tabs 511 extending laterally outwardly from a top portion thereof. The cover body 52 defines a pair of channels 521 at two opposite lateral sides thereof and a pair of posts 522 extending upwardly adjacent a rear end thereof. The channels 521 extend through a whole length of the cover body 52. Each channel 521 comprises a recessed section 524 adjacent to a front portion thereof and an engaging section 527 at a rear end thereof. The recessed section 524 recesses more deeply and widely than other portions of the channel 521 and defines a front end 525 and an opposite rear end 526 respectively connecting with front and rear sections of the channel 521. The engaging section 527 has a front end dimensioned the same as adjacent portion of the channel 521 and increases in the dimension thereof during the rearward extension thereof. The engaging section 527 has a forward tapered configuration. Each post 522 defines a hole 523 extending therein.

Each of the fastening members 60 is generally cylindrical and is called jack screw. Each of the fastening members 60 comprises an elongated medial portion 61, a grab portion 62, a transitional portion 63 between the medial portion 61 and the grab portion 62 and a head portion 64 extending forwardly from the medial portion 61. The medial portion 61 is formed with an annular stop section 65 protruding outwardly from a periphery of a front portion of the medial portion 61. The grab portion 62 is larger in diameter than the medial portion 61, and the transitional portion 63 has a forwardly tapered configuration. The transitional portions 63 correspond in geometry to the engaging sections 527 of the channels 521. An outer surface 620 of the grab portion 62 is slotted for increasing a friction between fingers of a user and the grab portion 62 when the user grabs the grab portion 62. The head portion 64 is in the shape of a bolt.

The electrical cable 70 comprises a plurality of electrical conductors 71 for soldering to the printed circuit board 26.

Each of the screws 80 comprises a fastening portion 81 and a retention portion 82 extending from the fastening portion 81.

Figure 4:
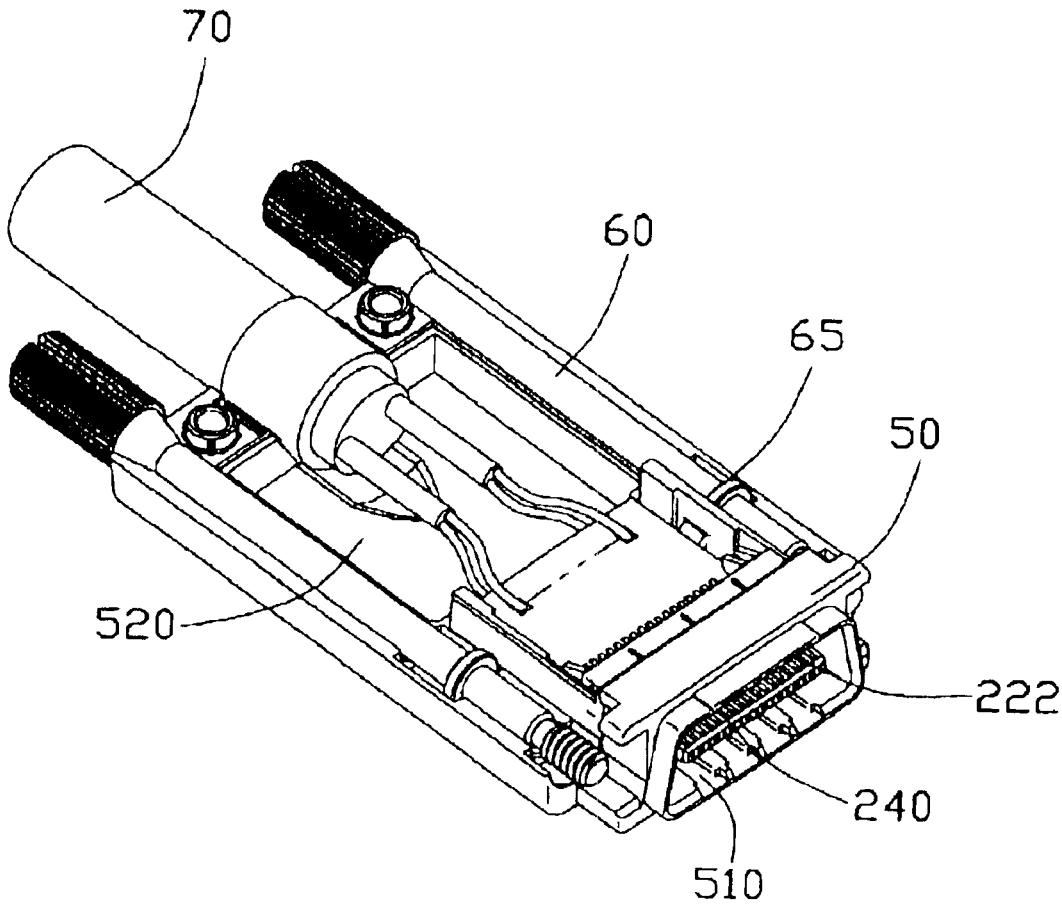
FIG. 4 is a partially assembled perspective view of FIG. 1 without an upper cover of the electrical cable connector assembly.
Figure 5:
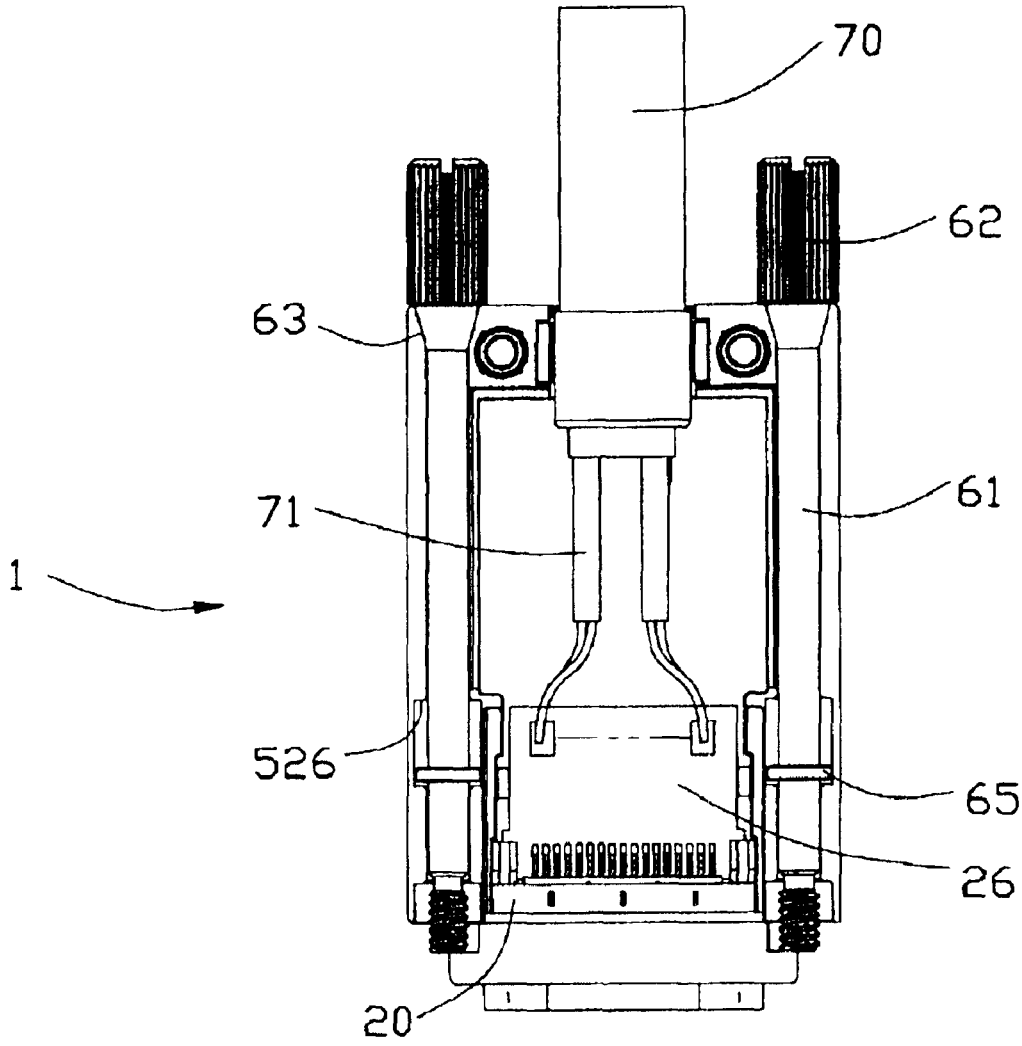
FIG. 5 is a top plan view of FIG. 4.

Referring also to FIGS. 4 and 5, in assembly, the contact module 20 is assembled in the lower cover 50 with the tongue portion 222 having the contact portions 240 thereon being accommodated in the cavity 510 and the printed circuit board 26 extending into the space 520. The conductive conductors 71 of the electrical cable 70 are soldered to the printed circuit board 26 to electrically connect with the electrical contacts 24 through the printed circuit board 26.

The fastening members 60 are put in the channels 521 with the stop sections 65 being located in the recessed sections 524.

Figure 6:
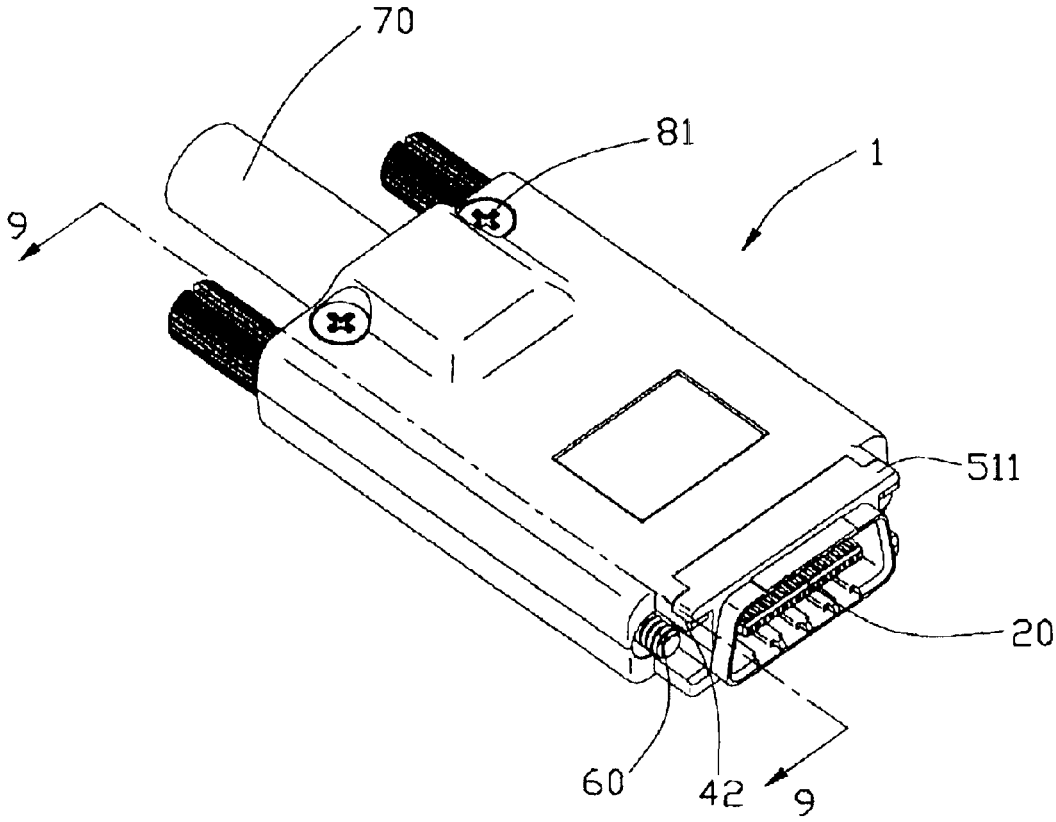
FIG. 6 is an assembled perspective view of FIG. 1.
Figure 7:
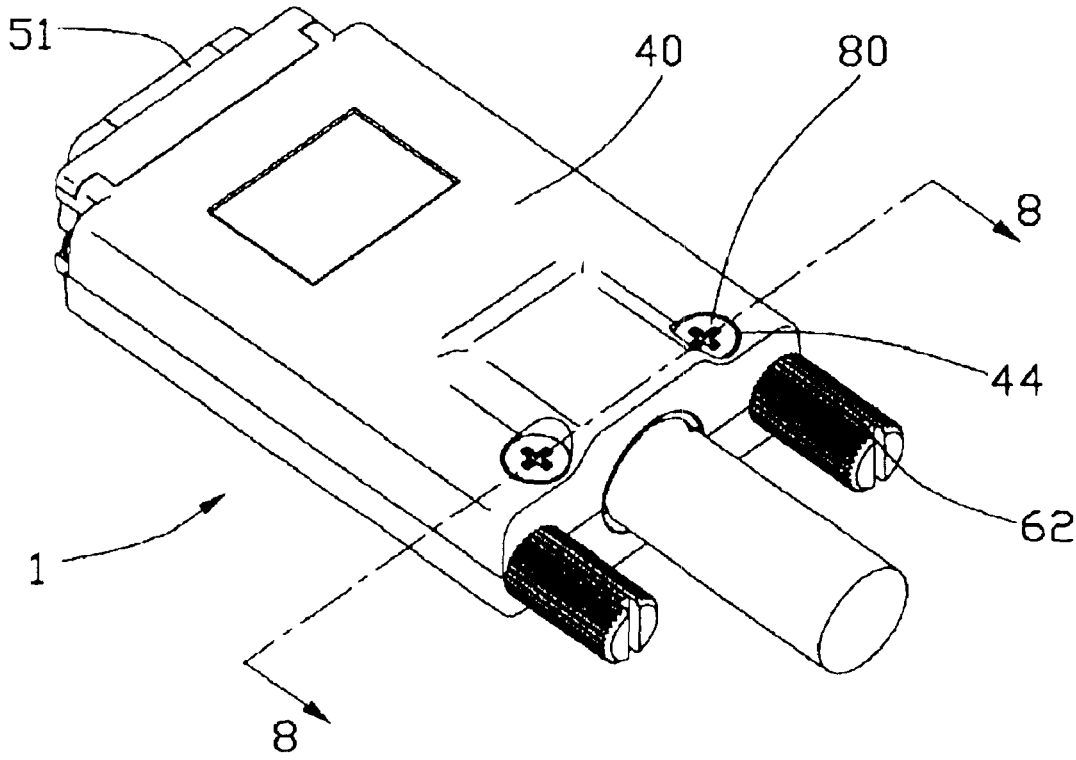
FIG. 7 is an assembled perspective view of FIG. 3.
Figure 8:
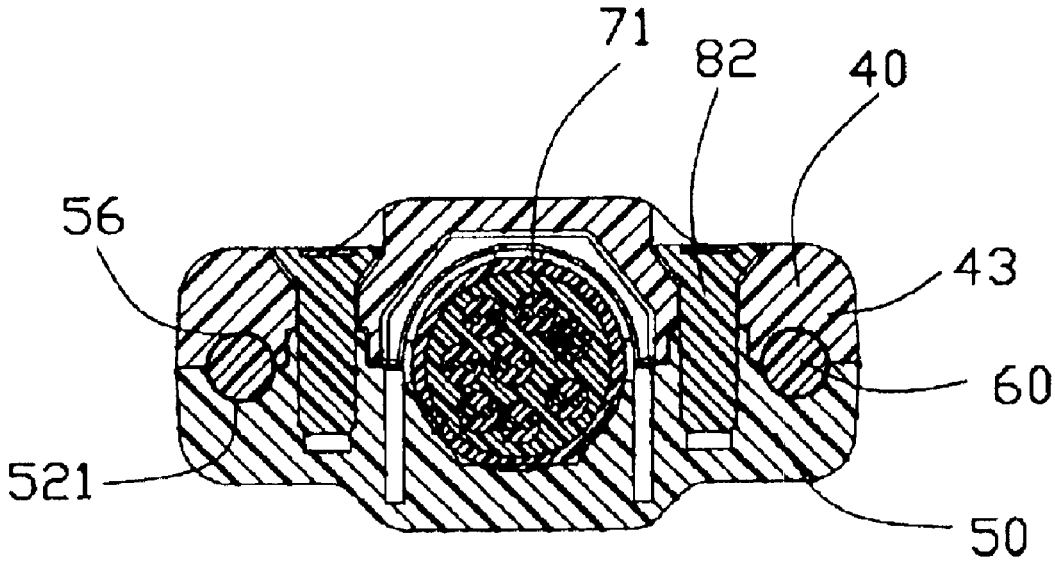
FIG. 8 is a cross-sectional view taken along line 8—8 of FIG. 7.

Referring also to FIGS. 6, 7 and 8, the fingers 42 extend partially below the tabs 511 to engage with the tabs 511 and the retention portions 82 of the screws 80 extend through the through holes 44 of the upper cover 40 into the holes 523 of the lower cover 50 to be secured to the posts 522. In such a way, the electrical cable connector assembly 1 is assembled together and the fastening members 60 are movably accommodated in passages 56 formed by the channels 521 of the lower cover 50 and the flanges 43 of the upper cover 40.

Figure 9:
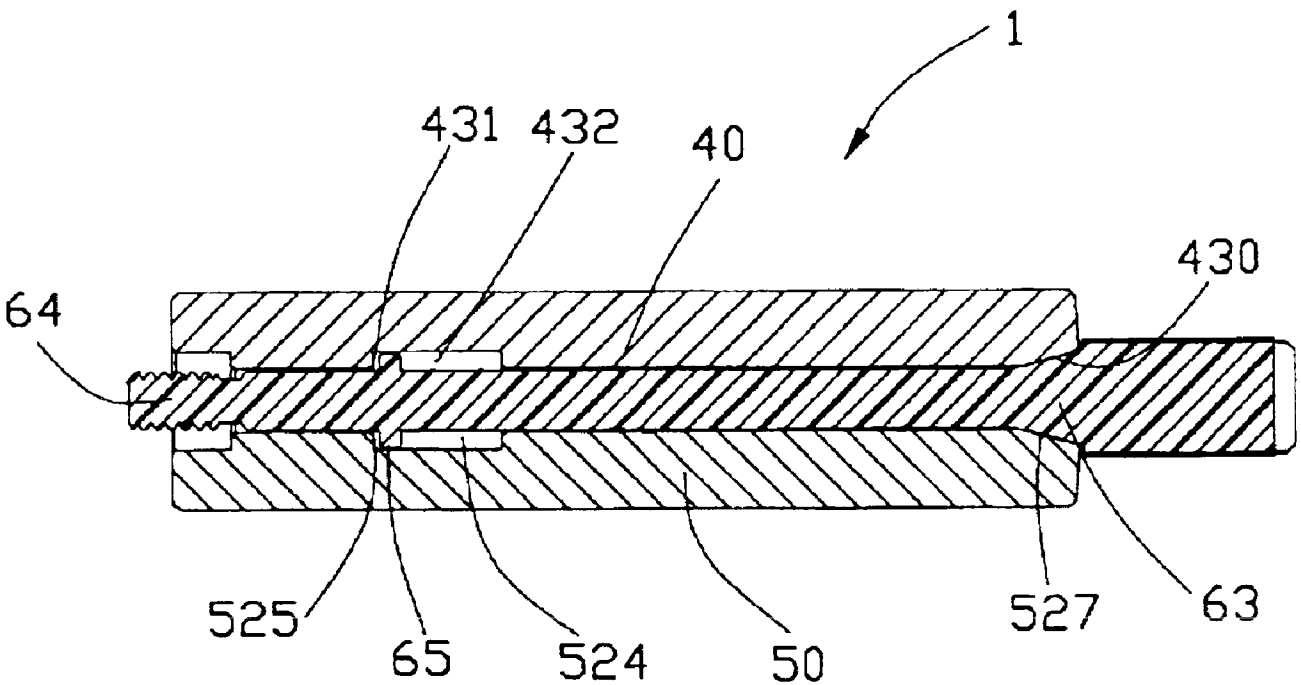
FIG. 9 is a cross-sectional view taken along line 9—9 of FIG. 6.

Referring also to FIG. 9, in use, when the electrical cable connector assembly 1 is to be locked with the complementary electrical connector, the grab portions 62 of the fastening members 60 are accessed by the user to push the fastening members 60 forwardly. The stop sections 65 move from the rear ends 526 toward the front ends 525, 431 of the recessed sections 524, 432 and finally located adjacent the front ends 525, 431 of the recessed sections 524, 432 of the lower and the upper covers 50, 40. The head portions 64 are rotated by rotating the grab portions 62 to thus engage with corresponding structures (such as nuts) of the complementary electrical connector, whereby the transitional portions 63 of the fastening members 60 fit matingly with the engaging sections 430, 527 of the upper and the lower covers 40, 50.

The transitional portions 63 have dimensions thereof larger than other portions of the fastening members 60 engaging with the covers 40, 50 and corresponding structures of conventional electrical connectors, so contacting areas between the covers 40, 50 and the fastening members 60 are ensured and in turn the retention force between the fastening members 60 and the covers 40, 50 are significantly increased and the retention between the fastening members 60 and the complementary electrical connector, in turn the mating between the electrical cable connector assembly 1 and the complementary electrical connector, is ensured.

In addition, by the mating tapered configurations of the transitional portions 63 of the fastening members 60 and the engaging sections 430, 527 of the covers 40, 50, the covers 40, 50 exert a rearward force to the transitional portions 63 (and accordingly the fastening members 60) when the head portions 64 completely threadedly engage with the complementary connector, whereby the head portions 64 can very tightly threadedly engage with the complementary connector so that even when the connector assembly 1 and the mated complementary connector are subject to vibration, the threaded engagement therebetween will not be easily loosen. Accordingly, the fastening members 60 can achieve a very reliably secure locking between the connector assembly 1 and the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable connector assembly comprising:

an insulative housing;

a plurality of electrical contacts being mounted to the insulative housing;

a first cover accommodating the insulative housing therein and defining a pair of channels;

a second cover being assembled to the first cover and comprising a pair of flanges, each of the flanges and a corresponding channel together defining a passage therebetween, the passage comprising an engaging section; and a pair of fastening members being movably secured in the passages and each comprising a medial portion, a head portion extending from the medial portion, a transitional portion extending from the medial portion opposite to the head portion, and a grab portion extending from the transitional portion and having a dimension larger than the medial portion, the transitional portion being engageable with the engaging section, the transitional portion increasing in a dimension thereof on extending from the medial portion to the grab portion.

2. The electrical cable connector assembly as claimed in claim 1, wherein the engaging sections correspond in geometry to the transitional portion.

3. The electrical cable connector assembly as claimed in claim 1, wherein the medial portion of the fastening member is formed with a stop section protruding from a periphery thereof and the passage comprises a recessed section movably receiving the stop section therein.

4. The electrical cable connector assembly as claimed in claim 1, further comprising a printed circuit board assembled to the insulative housing and electrically connected with the electrical contacts, and an electrical cable electrically connecting with the electrical contacts through the printed circuit board.

5. An electrical cable connector having a plurality of contacts for electrically connecting with a complementary connector, comprising:

a die cast cover having a front end, a rear end opposite the front end and at least a one passage extending through the front and the rear ends, the at least a one passage having a forwardly tapered engaging section and a recessed section recessing more deeply and widely than other portion of the at least one passage;

at least one fastening member rotatably received in the at least one passage and comprising a front threaded head portion adapted for threadedly engaging with the complementary connector, an outwardly protruding annular stop section received in the recessed section of the at least one passage, a rear grab portion and a forwardly tapered transitional portion connecting with the rear grab portion, the transitional portion of the at least a one fastening member being fitted in the engaging section of the at least one passage, whereby when the front threaded head portion threadedly engages with the complementary connector, the cover exerts a rearward force to the at least a one locking member through the transitional portion engaging with the engaging section;

an insulative housing being received in the cover;

a printed circuit board;

the contacts being received in the insulative housing and electrically connecting with an end of the minted circuit board; and a cable being electrically connected with another end of the printed circuit board and electrically connecting with the contacts via the printed circuit board.

6. An electrical cable connector having a plurality of contacts for electrically connecting with a complementary connector, comprising:

a cover including upper and lower halves and commonly defining a front end, a rear end opposite the front end and at least a passage extending through the front and the rear ends with a forwardly converged section around a rear portion thereof; and at least a fastening member rotatably received in the at least a passage and comprising a front threaded head portion exposed outside the front end of the passage and adapted for threadedly engaging with the complementary connector, a rear grab portion exposed outside the passage, and a forwardly converged transitional portion located in front of the rear grab portion, the forwardly transitional portion abutting against the forwardly converged section and preventing further forward axial movement of the at least a fastening member, wherein an additional holding device located around said forwardly converged section, provides a vertical assembling force for not only fastening the upper and lower halves together in a vertical direction, but also enhancing structures of forwardly converged section to urge the forwardly converged transitional portion backwardly.

* * * * *